United States Patent [19]

Brown et al.

[11] 3,999,276

[45] Dec. 28, 1976

[54] METHOD OF LAYING RAILROAD RAIL

[76] Inventors: Robert M. Brown, 2032 S. 113th Ave., Omaha, Nebr.; Melvin E. Byrne, 1173 S. 21st East, Salt Lake City, Utah; George H. Maxwell, 320 Frank St., Council Bluffs, Iowa

[22] Filed: Sept. 16, 1971

[21] Appl. No.: 181,105

[52] U.S. Cl. ..... 29/431; 29/447; 29/407; 29/DIG. 46; 104/2

[51] Int. Cl.[2] ..... E01B 29/02; E01B 29/42

[58] Field of Search ..... 29/431, 407, 429, 470, 29/447, DIG. 46; 104/2–17

[56] References Cited

UNITED STATES PATENTS

| | | | |
|---|---|---|---|
| 3,451,470 | 6/1969 | Herrick | 104/2 X |
| 3,566,796 | 3/1971 | Herrick | 104/2 |

OTHER PUBLICATIONS

Railway Track and Structures, vol. 65, No. 12, 1969, pp. 22–23.

Railway Track and Structures, vol. 66, No. 9, 1970, pp. 24–27.

*Primary Examiner*—C.W. Lanham
*Assistant Examiner*—Daniel C. Crane
*Attorney, Agent, or Firm*—Robert A. Ostmann

[57] ABSTRACT

The disclosure relates to laying railroad rail. The rail is placed on the unspiked tie plates of a roadbed. One end is fixed in place. Starting at the fixed end, successive sections of the rail are if necessary subjected to heat exchange to bring them to a predetermined temperature, relates to the mean ambient temperature of the locality where the rail is being laid. The necessary heating or cooling may be performed using means moved along the rail from the fixed end toward the free end. In order that rail may be laid at said predetermined temperature and while stress free, vibrations are imparted to the rail whereby any stress tending to develop in the rail from expansion or contraction, because of the temperature change, is relieved. The stress free rail at the predetermined temperature is then spiked in place and rail anchors are applied. By practice of the disclosed method, railroad track is produced which is stress free at said predetermined temperature and is uniformly stressed under other temperature conditions. These stresses are controlled by proper selection of the predetermined temperature used in laying operation.

1 Claim, 2 Drawing Figures

INVENTOR

BY

ATTORNEYS

METHOD OF LAYING RAILROAD RAIL

BACKGROUND OF THE INVENTION AND THE INVENTION

Figure 1:
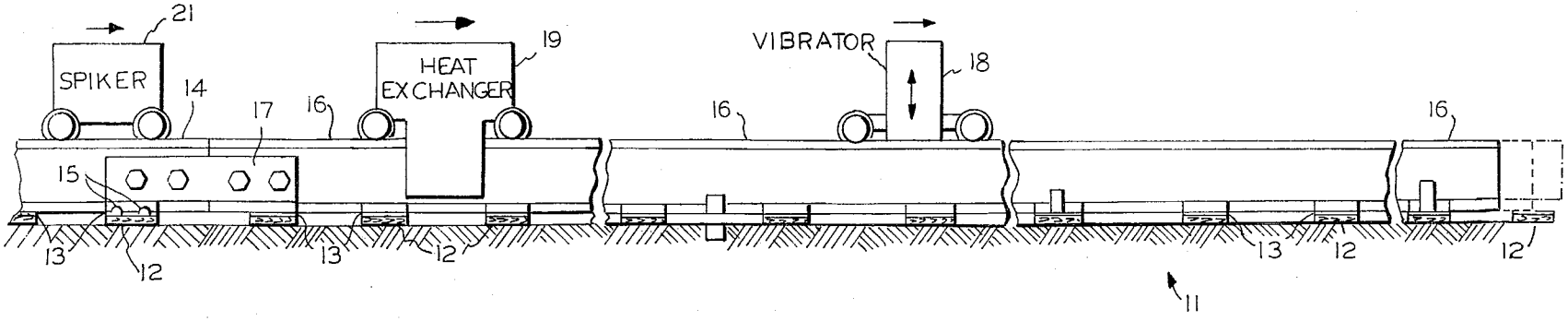

It has been proposed in laying railroad rails that they be fixed in place on the ties while the rail is at a preselected temperature. Proper selection of this temperature permits control of the stress of the fixed rail at the various temperatures to which it is subject. The advent of continuous welded rails (commonly called ribbon rail) has complicated the performance of this method. Welded rails are made of sections about 1400 feet in length which are transported to the site of the laying operation where they are unloaded and preliminarly placed upright on the tie plates. Even this preliminary placement introduces stress in the rail and this stress is not uniformly distributed. The individual sections weigh on the order of 35 tons and obviously are not easily moved. The end of the rail to be laid is connected to the end of an already laid rail and to the tie plates adjacent to that end. A portion of the new rail is then heated or cooled to a selected temperature by heat exchange means which traverses the rail. As the heat exchange means moves toward the free end of the rail, the portion of the rail over which it has just passed is fastened into place on the tie plates and to the ties, and anchors are applied. Experience with rails laid in this manner has been unsatisfactory. During the first winter of service, rail movement was noted. Such movement is particularly apparent at joints between rail sections where gaps developed.

Applicants concluded that the rails's length had not reached the stress free length that it would have at the temperature produced by the heat exchange, and had been fastened in place under stress and that this stress was not uniformly distributed. This conclusion is supported by observation of rail's behavior during laying with temperature adjustment. The rail's movement due to the change in length of the section undergoing temperature adjustment is not uniform. The movement is uneven and even sudden or spasmodic. This led to the conclusion that the expansion or contractin of the section being adjusted was being prevented by the friction between the base of the rail and the tie plates and by cocked tie plates. When the accumulated stress becomes large enough to overcome the friction, the spasmodic movement will occur. It was found that the rail could be caused to move somewhat sooner by striking it with a sledge hammer. It was also observed that the movement seems to occur more freely when pneumatic spike hammers were used cose to the heat exchange means.

Applicants surmised from their observations and experience that the rail could be freed so as to permit the adjusted section to change its length more freely by subjecting it to vibration. Thus they caused some rail to be laid while subject to the combined effects of heat exchange and vibration. A much more uniform accomodating movement was observed. Rail so oaid was checked throughout the following winter. Each joint was examined each week throughout the winter and at what appeared to be the high and low temperatures of the week. The rail movement was markedly less and only in isolated cases was it so extreme as to cause contact between the bolts and the bolt holes at the joints. The successful results of their experimental endeavor has lead to the velelopment of an improved vibrator described and claimed in the application of M. E. Bryne, filed on Jan. 3, 1972 under Ser. No. 214,756 now U.S. Pat. No. 3,768,859, confirmed applicants' conception of this method of laying railroad track.

The practice of the inventive method will be described with reference to the accompanying drawing in which FIG. 1 is a schematic side elevation showing practice of the invention. Neither relative size nor scale is shown.

Figure 2:
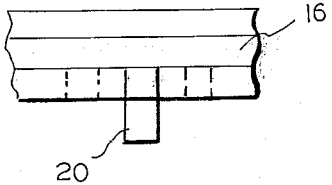

FIG. 2 is a top plan view showing the initial alinement of rail-carried gauge marks and those on the ballast or ties. The accompanying drawing illustrates the commencement of the laying of an additional rail section. The usual gravel ballast is generally indicated 11, and the ties at 12. A tie plate 13 is mounted on the usual adzed seat formed in he upper surface of each tie. The end of the previously laid rail section appears at 14 and, as shown, this section has been spiked in place by spikes 15. The additional rail section to be laid appears at 16. This rail section 16 has been placed so that it rests on the tie plates 13. The end of section 16 adjacent rail section 14 is brought in abutting relation with that rail section, and is secured thereto by means of bolted fish plates 17. At intervals from the fixed end aligned reference or gauge marks 20 are formed on the rail 16 and on the roadbed. This can be done conveniently by painting . The interval between gauge marks is selected so as to afford a plurality of, say four, marks dividing the section 16 in four equal parts each of a length slightly less than one quarter of the length of the rail section. The fourth mark is made near the free end of the rail section. (In actual practice the 1440 foot rail sections are made by welding 39 foot sections end to end to form the "ribbon" rail. The gauge marks are painted at the ninth, 18th, 27th and 36th welded joints, since the 39 foot sections are manufactured quite precisely to length and other standards.)

After the one end has been secured in place, a vibrator 18, a heat exchanger 19 and a spiker 21 are moved in succession onto and along the rail section 16. The effect of vibration is to free the rail section 16 of stresses including those introduced as it was placed on the tie plates and drawn into abutment with the section 14. The rail is heavy enough to produce frictional forces between the rail and the tie plates sufficient to prevent stress relief unless steps are taken to reduce these forces over a substantial rail length. Following vibration of an initial portion of the rail section 16, heat exchanger 19 is moved onto and along the rail section 16. The heat exchange may raise or lower the rail temperature according as to whether the existing temperature of the rail is above or below a predetermined level. The heat exchange effect perferably occurs simultaneously with vibration. This permits the rail portions undergoing heat exchange to grow in length if heated, or to shorten in length if cooled, and stress of substantial magnitude is not developed in the temperature-modified rail section. That is to say the vibration enables the rail to adjust its length to that length it would have when stress free at said predetermined temperature. Before any substantial temperature change can occur following the temperature adjustment caused by passage of the heat exchanger, the rail is spiked to the ties 12 and tie plates 13 by moving spiker 21 onto the rail section 16. There can be substantial intervals between vibrator 18, heat exchanger 19 and spiker 21. The vibrator 18 may take the form of a self-propelled vehicle such as that described in the previously mentioned Byrne application or it may take the form of a soil compacter such as that manufactured by Wacker Company Model VPG-16-KB Vibroplate. The soil compacter must be equipped with a special shoe to replace the compacter head. This shoe would take the form of an elongated channel. The web of the channel engages the rail head and its flanges extend downward on opposite sides of the rail. Other means of causing rail vibration will suggest themselves to those skilled in the art.

The rail can be caused to vibrate with an amplitude of one half inch or more near the vibrator, and vibrating movement of the rail can be detected over a portion of the rail six hundred feet in length. Because the vibrating rail moves toward and away from the tie plates on which it is resting, the frictional forces between the rail and the plates are diminished. The rail section can then change in length in response to temperature changes resulting from the heat exchange. Its free end will move toward or away from the fixed end without developing stress in the rail.

According to their experience it has been decided by the inventors that the rail should be fastened in place while substantially stress free and at a predetermined temperature higher than the mean ambient temperature at the geographical location in which the rail is to be laid. Preferably the predetermined temperature is $30° \pm 3°$ F higher than the mean ambient. The gauge or reference marks 20 are used as a means to ascertain that the change in rail length is uniformly distributed. It has been determined that the mark on the rail at the ninth weld should move nine-sixteenths inches for each 5° of temperature change with reference to the mark on the ballast or tie plate. The mark at the 18th weld will move twice that distance and that at the 27th weld three times that far, etc. During vibrating, heating and spiking, gauge mark movement is observed and when the vibrator, heat exchanger and spiker reach the end of rail section 16 its length should be equal to the length of a stress free rail section at said predetermined temperature.

The temperature to which the heat exchanger brings the rail may be adjusted. Under certain weather conditions, the rail will tend to return rapidly to its normal temperature from the adjusted temperature produced by the heat exchanger; under other conditions the reverse may be true. Such a departure from the normal rate of temperature change will be reflected by relative gauge mark movement which is too large or too small. This gauge mark movement can be controlled by adjusting the temperature produced by the heat exchange or it can be controlled by adjusting the vibratory effect as for example by changing the frequency of the vibrations imposed on the rail by vibrator 18.

A rail laid in accordance with the teachings of this invention will, at most times of the year, be stressed in tension. This is desirable, because a rail stressed in tension tends to lie straight and resist lateral displacement. Conversely the compressive stresses developed in the rail when it is subject to high temperature will be reduced and any tendency toward lateral movement and buckling is diminished.

Experimental experience with railroad rails laid using this method indicates that rail movement while in use in main line service is reduced and that the joints between successive sections of ribbon rail remain in good condition under conditions of high and low temperature extremes such as may be encountered in Death Valley and at Pocatello, Idaho. The vibrator and spiker may be used without the heat exchanger when the rail is at the predetermined temperature and neither heating nor cooling is required. Such use of the vibratory effect will cause stress introduced by placement of the ribbon rail on the tie plates to be relieved and insure that the rail has attained its proper stress free full length.

We claim:

1. The method of laying of a railroad rail which comprises:

a. placing the rail on a roadbed;

b. securing one end of the rail against movement;

c. subjecting the rail to the combined effect of heat exchange and vibration, the heat exchange producing a rail temperature $30° \pm 3°$ F higher than the mean ambient temperature at the location where the rail is being laid, and the combined effect being such as to produce a stress-free rail having a predetermined length different from the length it has at the then existing ambient temperature; and d. fixing the rail of said predetermined length to the roadbed.

* * * * *